US012565352B2

(12) United States Patent
Yamada

(10) Patent No.: US 12,565,352 B2
(45) Date of Patent: Mar. 3, 2026

(54) FOLDED-SHEET CONTAINER

(71) Applicant: OKUMURA PRINTING CO., LTD., Tokyo (JP)

(72) Inventor: Hideo Yamada, Tokyo (JP)

(73) Assignee: OKUMURA PRINTING CO., LTD., Tokyo (JP)

( * ) Notice: Subject to any disclaimer, the term of this patent is extended or adjusted under 35 U.S.C. 154(b) by 67 days.

(21) Appl. No.: 18/570,069

(22) PCT Filed: Jun. 23, 2022

(86) PCT No.: PCT/JP2022/025182

§ 371 (c)(1),
(2) Date: Dec. 14, 2023

(87) PCT Pub. No.: WO2022/270599

PCT Pub. Date: Dec. 29, 2022

(65) Prior Publication Data

US 2024/0383637 A1 Nov. 21, 2024

(30) Foreign Application Priority Data

Jun. 24, 2021 (JP) ..... 2021-104835

(51) Int. Cl.
*B65D 5/22* (2006.01)
*B65D 3/08* (2006.01)
*B65D 5/20* (2006.01)

(52) U.S. Cl.
CPC ..... *B65D 5/2019* (2013.01); *B65D 3/08* (2013.01); *B65D 5/22* (2013.01)

(58) Field of Classification Search
CPC ..... B65D 5/22; B65D 3/08; B65D 5/2019; B65D 5/2038; B65D 5/24
(Continued)

(56) References Cited

U.S. PATENT DOCUMENTS 3,447,672 A * 6/1969 Bailey ..... B65D 5/545 229/116.1
3,565,325 A * 2/1971 Pugsley ..... B65D 5/3628 229/117.16
(Continued)

FOREIGN PATENT DOCUMENTS

GB 2418417 A 3/2006
JP S56-141122 U 10/1981
(Continued)

*Primary Examiner* — Steven A. Reynolds
(74) *Attorney, Agent, or Firm* — HAUPTMAN HAM, LLP

(57) ABSTRACT

A folded-sheet container includes a bottom in a center portion of a sheet, side walls adjacent to the bottom, first and second folding lines from a periphery of the bottom toward a periphery of the sheet, a dart portion formed by folding back the sheet along the first folding line, a flap in an end portion opposing the bottom of the side wall and configured to be folded back, and an insertion piece in the flap. The dart portion is folded back along the second folding line to be overlaid on the side wall, the flap is folded back to sandwich the dart portion between the side wall and the flap, the insertion piece in the flap is folded back to be inserted into the dart portion, and the opposing two side walls as one pair are both curved to outwardly project in a radial direction in a plan view.

5 Claims, 12 Drawing Sheets

(58) Field of Classification Search
USPC ..... 206/557; 229/108
See application file for complete search history.

(56) References Cited

U.S. PATENT DOCUMENTS

| | | | | | |
|---|---|---|---|---|---|
| 3,610,512 | A * | 10/1971 | Hermalin | B65D 5/3685 | 229/117.06 |
| 4,126,265 | A * | 11/1978 | Holmes | B65D 5/006 | 206/509 |
| 4,199,097 | A * | 4/1980 | Christensson | B65D 5/2038 | 229/199 |
| 7,870,995 | B1 * | 1/2011 | Kaltman | B65D 5/68 | 229/175 |
| 11,827,430 | B2 * | 11/2023 | Brink | B65D 5/246 | |
| 2024/0017873 | A1 * | 1/2024 | Mack | B65D 5/6661 | |

FOREIGN PATENT DOCUMENTS

| | | | |
|---|---|---|---|
| JP | S57-156411 | U | 10/1982 |
| JP | S64-026220 | U | 2/1989 |
| JP | H1-153130 | U | 10/1989 |

* cited by examiner

FOLDED-SHEET CONTAINER

RELATED APPLICATIONS

The present application is a National Phase of International Application No. PCT/JP2022/025182 filed Jun. 23, 2022, which claims priority to Japanese Application No. 2021-104835, filed Jun. 24, 2021.

TECHNICAL FIELD

The present invention relates to a folded-sheet container formed by folding one sheet made of paper or a synthetic resin.

BACKGROUND ART

It is preferable that containers such as dishes used at camping sites or evacuation sites are flat and not bulky when not in use and can be easily three-dimensionally formed in use in terms of portability and convenience in storage.

Thus, conventionally, there has been a container that is three-dimensionally formed by folding one sheet. For example, Patent Literature 1 discloses a paper container for cooking by boiling, in which flame-retardant synthetic paper is formed into one piece of paper in an octagonal shape and an octagonal shape analogous to the shape of the piece of paper is demarcated in a center of the piece of paper, folding lines extending from points to which the sides of the demarcated octagonal shape are extended and leading to the apices on the outer periphery of the octagonal shape and folding lines orthogonal to sides continuous with the apices are provided, and then, portions surrounded by these folding lines are folded in between the adjacent two sides and are further overlaid on the two sides to be bonded.

CITATION LIST

Patent Literature

[Patent Literature 1]
Japanese Utility Model Laid-Open No. 1-153130

SUMMARY OF INVENTION

Technical Problem

The paper container as described in the aforementioned Patent Literature 1 is a flat sheet that is not bulky when not in use and can be formed into a three-dimensional pan shape by folding in use. However, to maintain the three-dimensional shape, a folded portion needs to be bonded, which makes the assembling work burdensome. In addition, the paper container cannot restore the sheet form after use.

A problem to be solved by the present invention is to provide a folded-sheet container that is not bulky when not in use because of its sheet form and can be easily assembled in use, and further that is less deformable because of the strength of the sheet container and can restore the sheet form, which is not bulky, after use, as necessary.

Solution to Problem

The present invention relates to a folded-sheet container formed by folding a sheet, the folded-sheet container including: a bottom provided in a substantially center portion of the sheet; a side wall provided adjacent to the bottom; a first folding line and a second folding line that are provided from a point in a periphery portion of the bottom toward an outer periphery of the sheet; a dart portion formed by folding back the sheet along the first folding line; a flap that is provided in an end portion opposing the bottom of the side wall and that can be folded back; and an insertion piece provided in the flap, in which the dart portion is folded back along the second folding line to be overlaid on the side wall, the flap is folded back to sandwich the dart portion between the side wall and the flap, and the insertion piece provided in the flap is folded back to be inserted into the dart portion.

It is preferable that the dart portion is overlaid on an outer surface of the side wall and that the flap is folded back toward an outer surface side.

In some cases, the dart portions positioned on opposite sides of the side wall are overlaid on the side wall, the insertion piece is provided, at a tip end of the flap provided in the end portion of the side wall, between the dart portions positioned on the opposite sides and the insertion piece is folded back to be inserted into the dart portions on the opposite sides.

Alternatively, there are also some cases in which the dart portions positioned on the opposite sides of the side wall are overlaid on the side wall and upper portions of the dart portions are folded downward to form locking portions, the insertion pieces are provided in opposite side portions of the flap provided at an upper end of the side wall, and the insertion pieces are folded back to be inserted into the locking portions of the dart portions.

It is preferable that the side wall is at least partially bent or curved so as to project toward the outer surface side in a plan view.

In this case, occasionally, two pairs of opposing two side walls as one pair are included, and at least one pair of the side walls are bent or curved so as to outwardly project in a radial direction in a plan view.

Advantageous Effects of Invention

According to the present invention, the folded-sheet container is in a sheet form when not in use, and is thus not bulky when carried outdoor or stored at evacuation sites or the like. In addition, there is no risk of breakage and a three-dimensional container can be easily formed by simply folding a sheet in use. Moreover, after use, the original sheet form can be restored as necessary, which avoids burden in carrying away.

Since dart portions are pressed by a flap folded back from a side wall and are sandwiched and locked by the flap and an insertion piece folded back from the flap, the strength is enhanced to be able to prevent the dart portions from opening and falling apart in use.

Further, when the side wall is at least partially bent or curved so as to outwardly project in a radial direction, the strength is increased to be less deformable in use. Furthermore, with the outwardly expanding force of the side wall, the insertion piece inserted into the dart portions does not easily fall off.

DESCRIPTION OF EMBODIMENTS

Hereinafter, embodiments of the present invention will be described in detail with reference to the drawings. Note that it goes without saying that the present invention is not limited to the embodiments.

First Embodiment

FIG. 1 and FIG. 2A to FIG. 2H show a first embodiment of the present invention.

Figure 1:
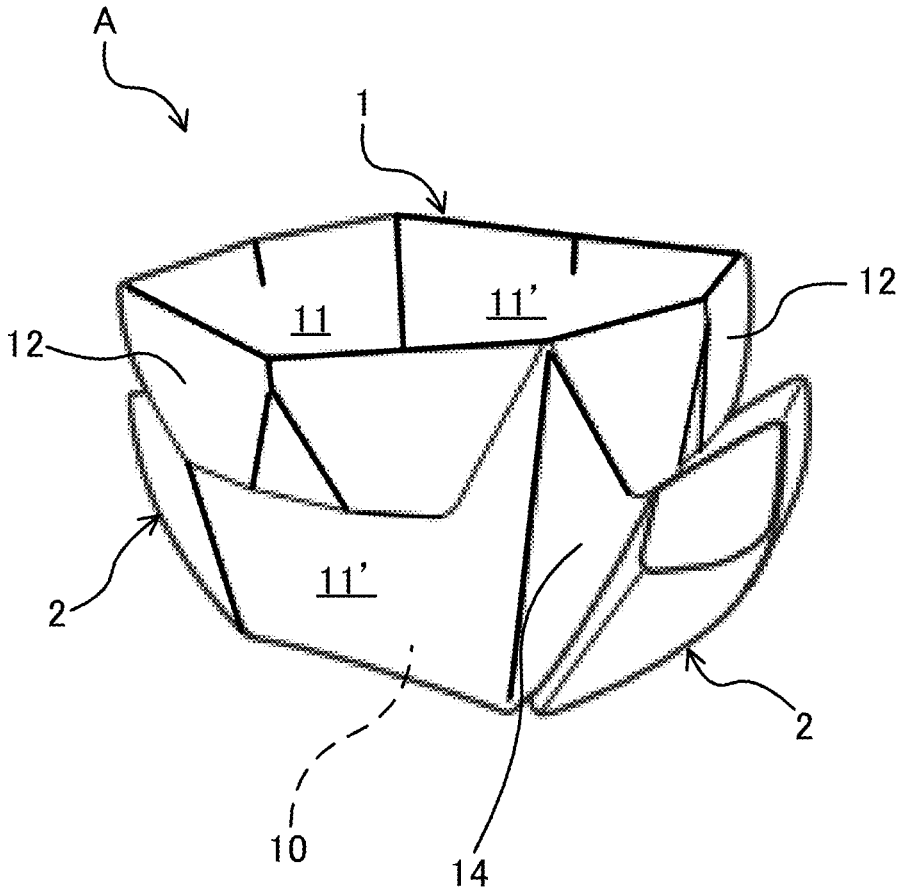
FIG. 1 is a perspective view of a folded-sheet container showing a first embodiment of the present invention.

As shown in FIG. 1, in the first embodiment, a folded-sheet container is a cup A, which is formed by folding one sheet 1.

The cup A is configured such that two pairs of opposing two side walls 11 as one pair and opposing two side walls 11' as one pair in a direction orthogonal to the side walls 11 are raised from a periphery of a substantially quadrangular bottom 10, and a handle 2 is attached to an outer surface of each side wall 11.

Figure 2A:
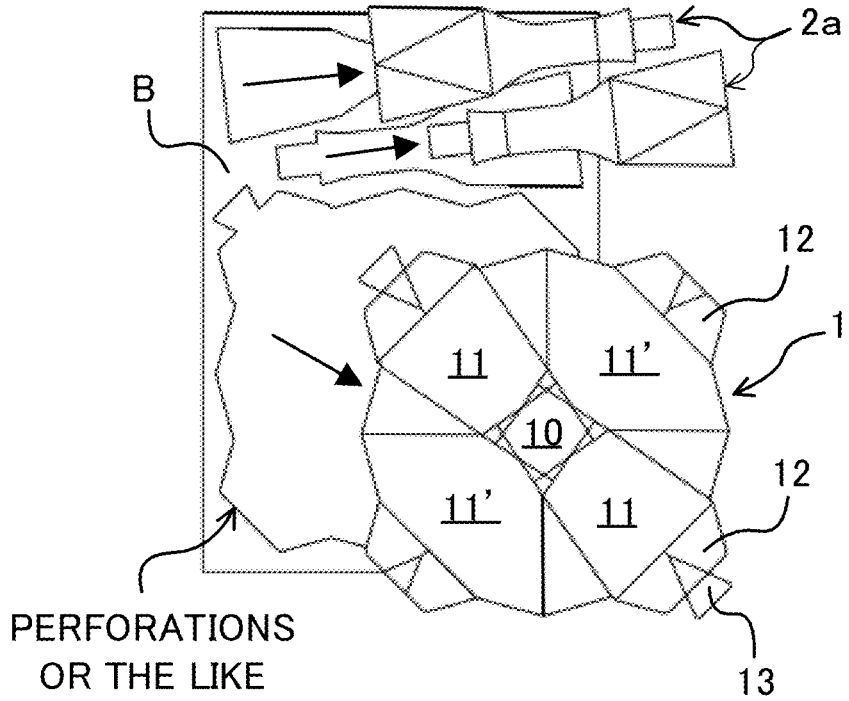
FIG. 2A is a plan view showing a forming procedure of the folded-sheet container according to the first embodiment of the present invention.

To form the cup A, first, one sheet 1 and two sheets 2*a* for a handle are cut out from a rectangular mount B as shown in FIG. 2A.

The mount B is thick paper with the surface treated for water repellency, a synthetic resin sheet, or the like.

Further, the perimeters of the sheet 1 and the sheets 2*a* for a handle are demarcated by breakable lines such as perforations.

Figure 2B:
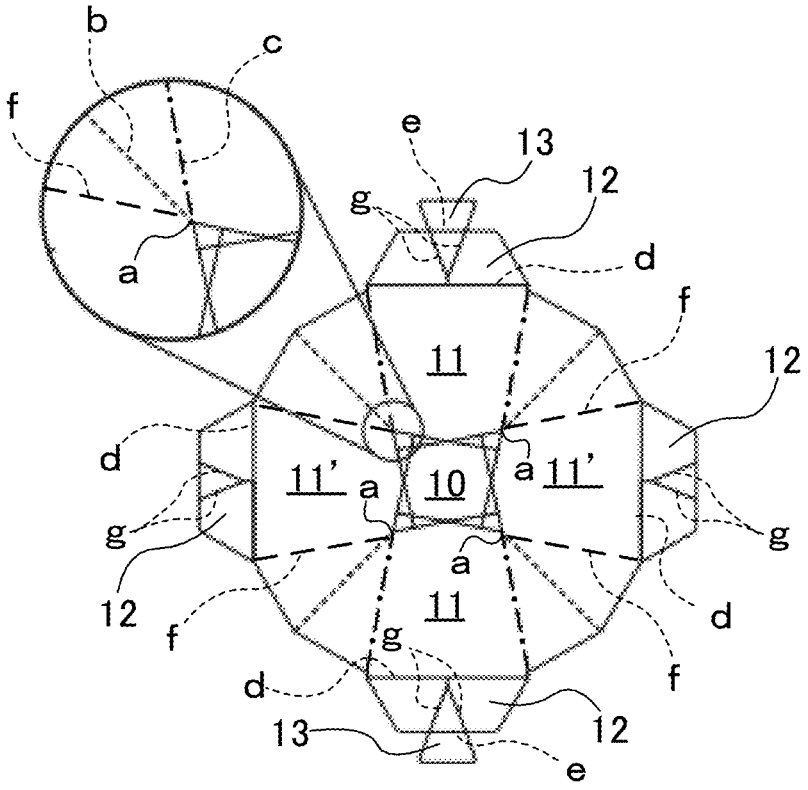
FIG. 2B is a plan view showing the forming procedure of the folded-sheet container according to the first embodiment of the present invention.

As shown in FIG. 2B, the bottom 10 is demarcated in a substantially center portion of the sheet 1. In the present embodiment, since a curve without a bend with a crease is formed between the bottom 10 and the side walls 11, 11', no distinct folding line is formed on the periphery of the bottom 10.

On the periphery of the bottom 10, a first folding line b and a second folding line c are each radially provided from four points a that are equidistantly set in a circumferential direction at corners of the bottom 10 toward an outer periphery of the sheet 1.

Four first folding lines b are formed from the points a of the bottom 10 toward an outer periphery surface of the sheet 1, radially toward the outer periphery surface of the sheet 1 from the substantially center portion of the sheet 1. The first folding lines b are formed in a direction orthogonal to one another on the sheet 1. Further, the second folding lines c are provided so as to form boundaries on the left and right sides of the side wall 11 at completion. Furthermore, the two second folding lines c extending from the adjacent points a as one pair, and the two second folding lines c extending from the points a as the other pair are formed so as to oppose each other in a state of being sandwiched by the first folding lines b on the opposite sides.

The side wall 11 is formed between the opposing two second folding lines c, and a flap 12 is continuously provided, via a flap folding back line d, at an outer end in a radial direction (upper end of the cup A) of the side wall 11. An insertion piece 13 is continuously provided, via an insertion piece folding back line e, in a center portion at a tip end of the flap 12.

The flap 12 is in a trapezoidal shape narrowed on a tip end side and the insertion piece 13 is formed in a trapezoidal shape widened on a tip end side. Further, a folding and bending line g for reinforcement is formed in the flap 12 along a line that is an extended side rim of the insertion piece 13.

When an imaginary line f is set at a position that is in a line symmetry with the second folding line c relative to the first folding line b so as to extend toward the outer periphery of the sheet 1 from each point a, the side wall 11' is formed between the imaginary lines d opposing each other.

The side wall 11' is substantially in the same shape as that of the side wall 11 formed between the second folding lines c, and the flap 12 is continuously provided, via the flap folding back line d, at an outer end in a radial direction (upper end of the cup A) of the side wall 11'. The folding and bending line g for reinforcement is formed in the flap 12.

Note that the opposing two second folding lines c as one pair and the opposing two imaginary lines d as one pair, which respectively form the side wall 11 and the side wall 11', are formed so as to widen from a side proximal to the bottom 10 toward the outer periphery of the sheet 1, so that the side wall 11 and the side wall 11' are widened on the upper sides.

Figure 2C:
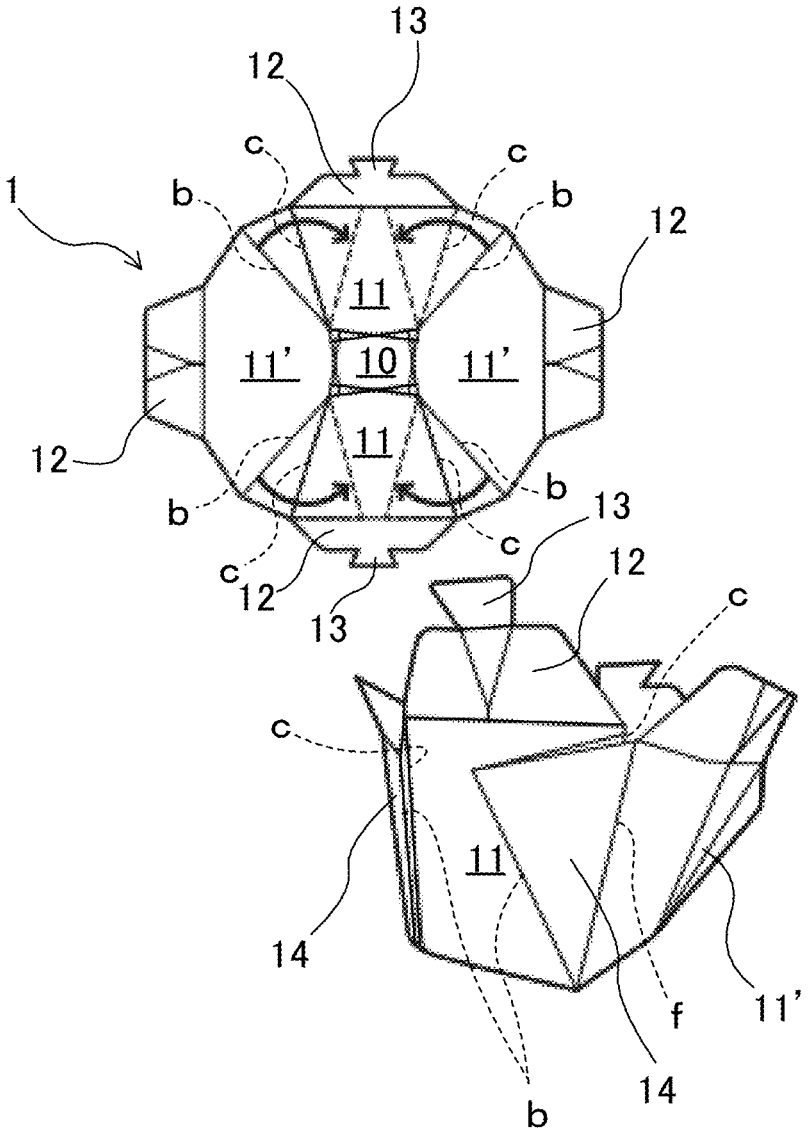
FIG. 2C illustrates a plan view and a perspective view showing the forming procedure of the folded-sheet container according to the first embodiment of the present invention.

As shown in FIG. 2C, the sheet 1 is mountain-folded along the first folding line b, and a portion sandwiched between the first folding line b and the second folding line c and a portion sandwiched between the first folding line b and the imaginary line f are overlaid. In this manner, a triangular dart portion 14 that is wider on the outer periphery side of the sheet 1 is formed, so that the side walls 11, 11' are raised from the periphery of the bottom 10. At this time, a site along the imaginary line f curves, but no distinct crease is provided in the imaginary line f.

Since the side walls 11, 11' are in a shape widened upward, an opening portion surrounded by upper ends of the side walls 11, 11' is larger in area than the bottom 10.

By valley folding along the second folding lines c, the dart portions 14 are overlaid on opposite sides of the outer surface of the side wall 11 that has the insertion piece 13 at a tip end.

Figure 2D:
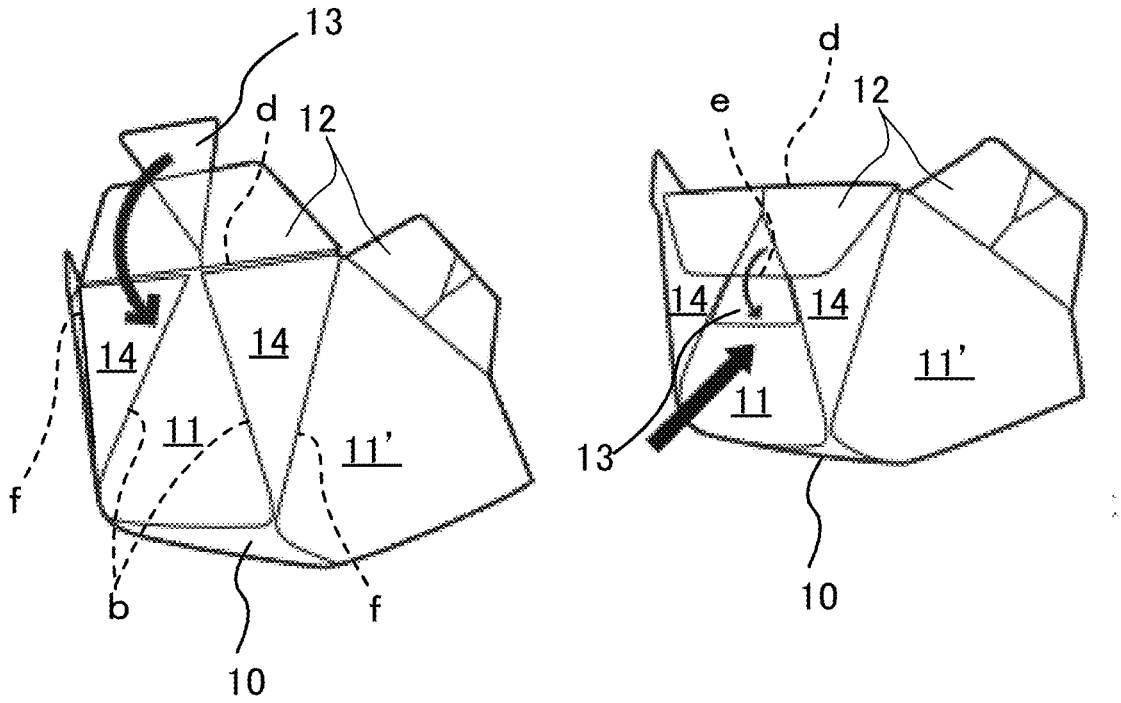
FIG. 2D is a perspective view showing the forming procedure of the folded-sheet container according to the first embodiment of the present invention.

Note that as shown in the drawing on the left side of FIG. 2D, upper ends of the portion between the first folding line b and the imaginary line f and the portion between the first folding line b and the second folding line c are linearly formed so as to correspond to the flap folding back line d as the upper end of the side wall 11 when overlaid.

Next, as shown in FIG. 2D, the flap 12 is folded downward on the outer surface side from the flap folding back line d and the dart portions 14 are sandwiched between the flap 12 and the side wall 11.

At this time, the insertion piece 13 provided in the center portion at the tip end of the flap 12 is positioned between the dart portions 14 on the opposite sides.

Figure 2E:
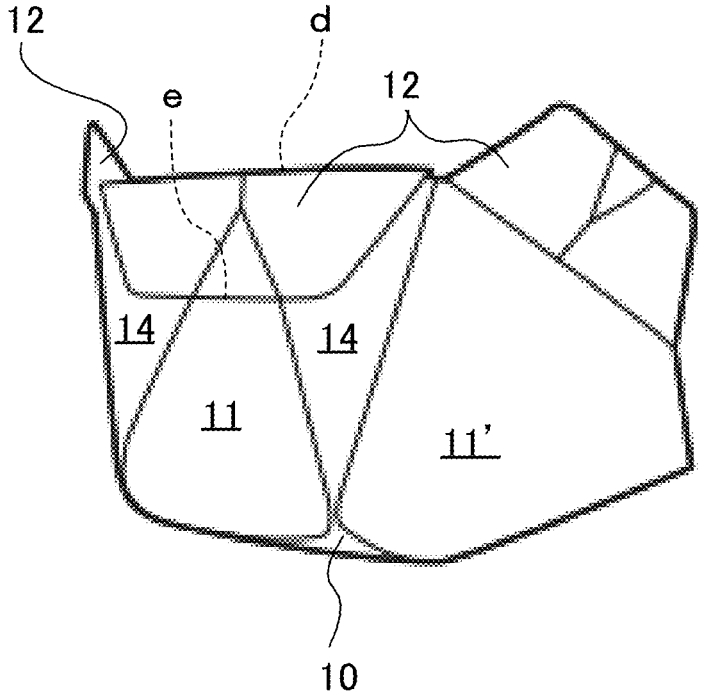
FIG. 2E is a perspective view showing the forming procedure of the folded-sheet container according to the first embodiment of the present invention.

Further, the insertion piece 13 is folded back along the insertion piece folding back line e to be inserted into the dart portions 14 on the opposite sides from below. FIG. 2E is a view showing the state of the insertion piece 13 inserted into the dart portions 14. When the insertion piece 13 is inserted into the dart portions 14 while slightly pressing the side wall 11 inward, it becomes easier to insert the insertion piece 13 into the dart portions 14.

The flap 12 and the insertion piece 13 sandwich and lock the dart portions 14. Since the insertion piece 13 is in a trapezoidal shape, opposite side portions of the insertion piece 13 are deeply inserted between the side wall 11 and the dart portions 14 so as not to easily fall off, thereby making it possible to prevent the dart portions 14 from opening.

Figure 2F:
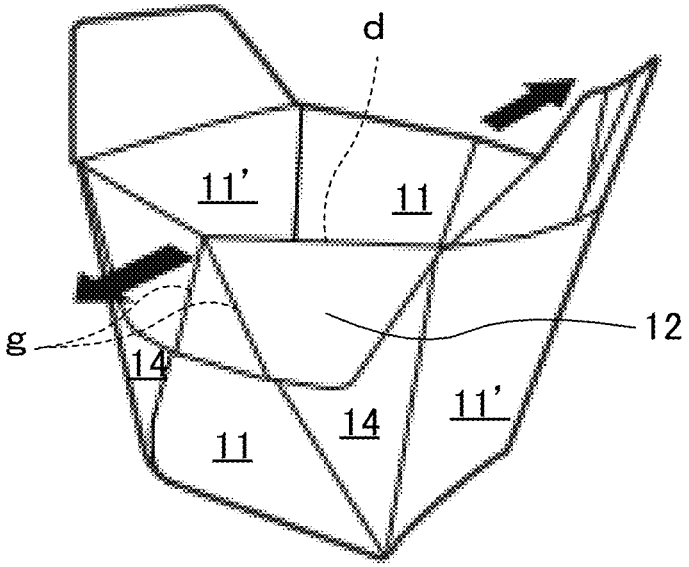
FIG. 2F is a perspective view showing the forming procedure of the folded-sheet container according to the first embodiment of the present invention.
Figure 2G:
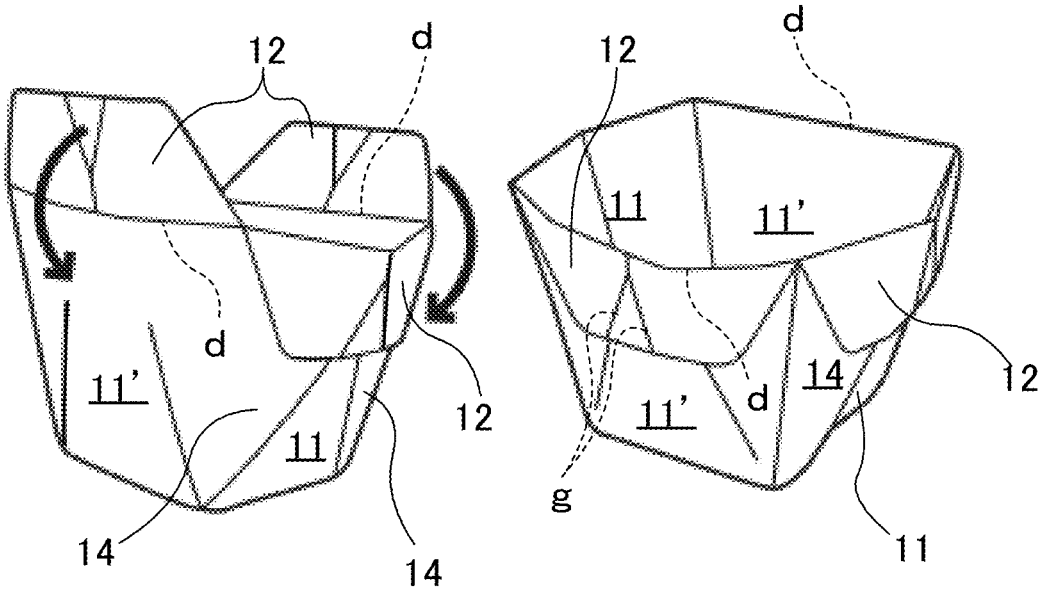
FIG. 2G is a perspective view showing the forming procedure of the folded-sheet container according to the first embodiment of the present invention.

Next, as shown in FIG. 2F, a center in an upper end portion of the side wall 11 is folded outward in a radial direction to bend the side wall 11 so as to outwardly project in a plan view. Thereafter, as shown in FIG. 2G, the flap 12 provided at the upper end of the side wall 11' where the dart portions 14 are not overlaid is folded outward in the radial direction along the flap folding back line d. Further, the side wall 11' is then bent so as to outwardly project. By bending so as to outwardly project, with the outwardly expanding force of the side wall 11', the insertion piece 13 inserted into the dart portions 14 does not easily fall off. Note that the folding and bending line g for reinforcement is formed in the flap 12 as shown in FIG. 2F and FIG. 2G. Therefore, the side walls 11, 11' can be easily bent without being deformed when bent so as to outwardly project.

Figure 2H:
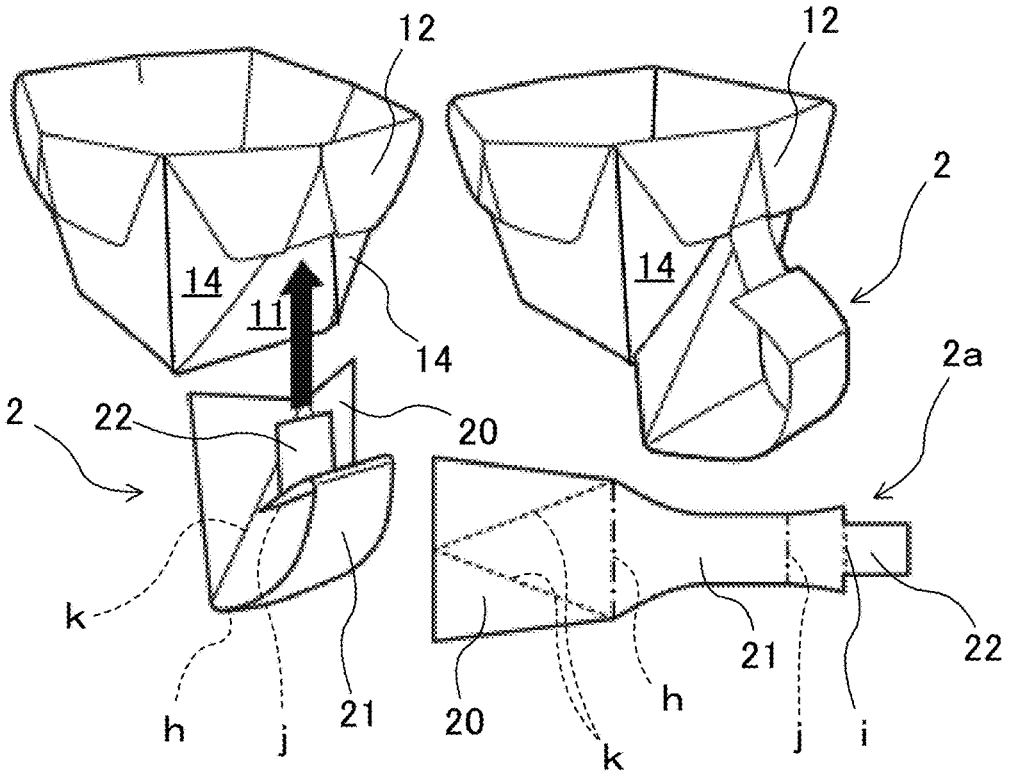
FIG. 2H is a perspective view showing the forming procedure of the folded-sheet container according to the first embodiment of the present invention.

As shown in FIG. 2H, the sheet 2*a* for a handle includes a trapezoidal superposed piece 20 that is superposed on the outer surface of the side wall 11. A holding portion 21 in a strap shape extends integrally from the short side of the superposed piece 20 via a bend line h. Further, a tuck-in piece 22 slightly narrower is continuously provided at a tip end of the holding portion 21 via a tip end portion bend line i parallel to the bend line h. A middle portion bend line j is formed in parallel with the bend line h so as to be slightly closer to the superposed piece 20 as compared to the tip end portion bend line i.

Oblique folding lines k are formed in the superposed piece 20 from opposite ends of the bend line h toward the center in the long side of the superposed piece 20.

The holding portion 21 of the sheet 2*a* for a handle is folded from the bend line h toward the outer side of the superposed piece 20. A tip end side from the middle portion bend line j is then bent toward the superposed piece 20. Thereafter, the tuck-in piece 22 is folded up from the tip end portion bend line i so as to be parallel with the superposed piece 20 to form the generally substantially annular handle 2. Opposite side portions closer to the long side of the superposed piece 20 are folded along the oblique folding lines k as shown in FIG. 2H.

The superposed piece 20 of the handle 2 is inserted, from below, between the side wall 11, and the dart portions 14 on the opposite sides and insertion piece 13 as shown in FIG. 2H. The tuck-in piece 22 is inserted, from below, between the superposed piece 20 and the insertion piece 13, so as to be attached to the outer surface of the side wall 11.

The superposed piece 20 is folded along the oblique folding lines k and has elasticity, and thus does not easily fall off from between the side wall 11 and the dart portions 14, and the tuck-in piece 22 is also prevented from falling off from the dart portions 14.

In this manner, the cup A as shown in FIG. 1 is formed.

Second Embodiment

A second embodiment of the present invention will be described with reference to FIG. 3 and FIG. 4A to FIG. 4D. The detailed description of the same structures as those of the first embodiment will be omitted.

Figure 3:
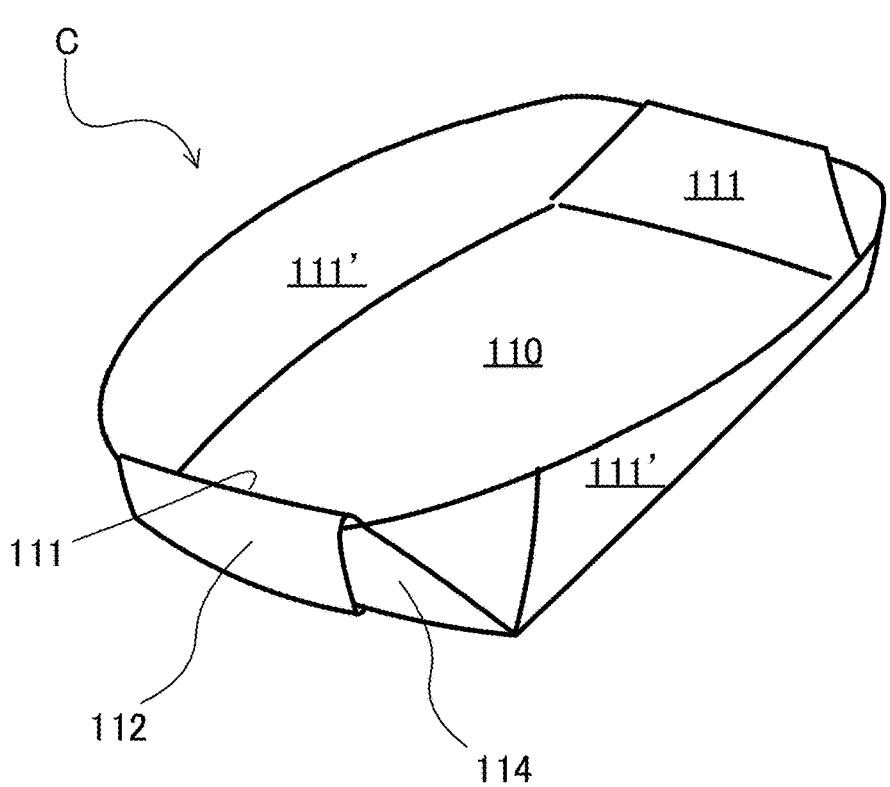
FIG. 3 is a perspective view of the folded-sheet container showing a second embodiment of the present invention.

As shown in FIG. 3, in the second embodiment, the folded-sheet container is a plate C.

The plate C is formed by folding one sheet 101 and includes a substantially rectangular bottom 110. Further, opposing two side walls 111 are raised from the short sides of the bottom 110 and opposing two side walls 111' are raised from the long sides.

The side walls 111, 111' are lower in height than the side walls 11, 11' of the first embodiment, and the side walls 111' are curved so as to outwardly project in a plan view.

Figure 4A:
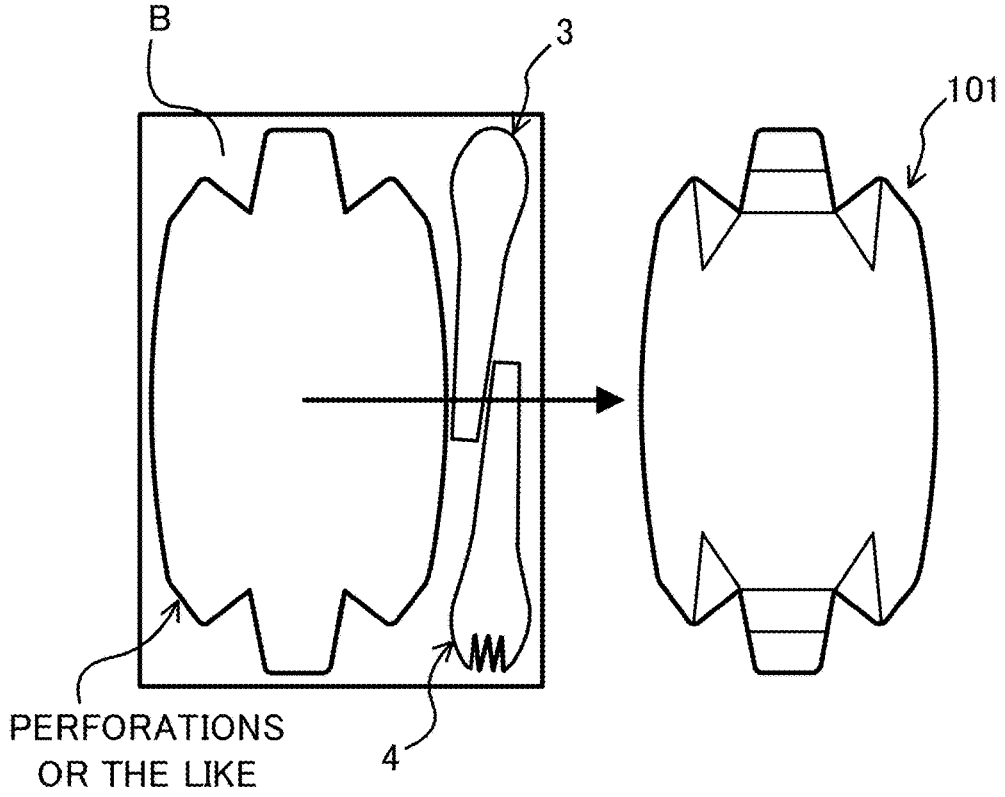
FIG. 4A is a plan view showing a forming procedure of the folded-sheet container according to the second embodiment of the present invention.

As shown in FIG. 4A, one sheet 101, a spoon 3, and a fork 4 are cut out from the mount B.

Figure 4B:
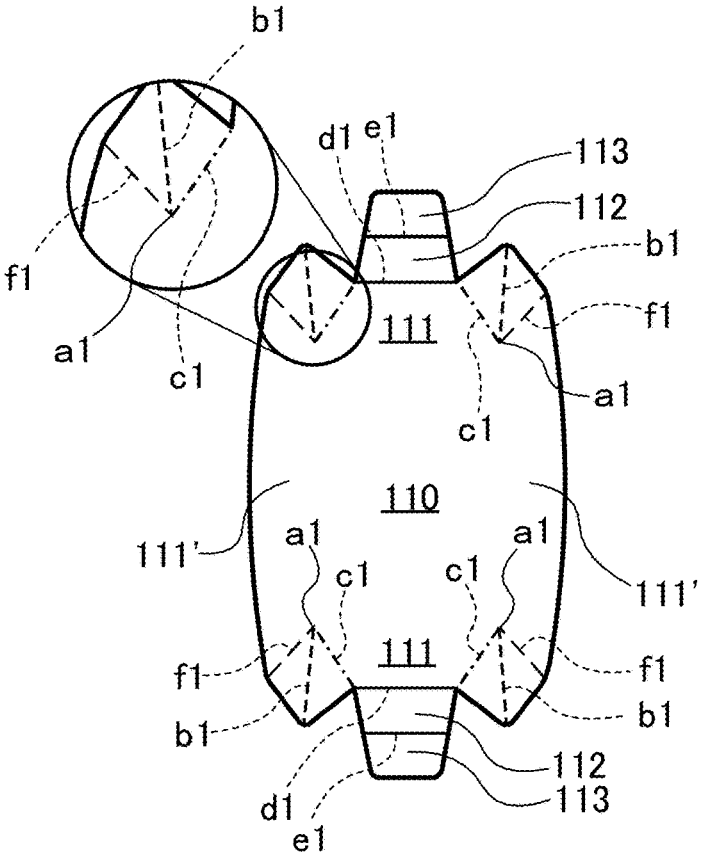
FIG. 4B is a plan view showing the forming procedure of the folded-sheet container according to the second embodiment of the present invention.

As shown in FIG. 4B, the bottom 110 is demarcated in a center portion of the sheet 101 and points a1 are set at positions corresponding to four corners on a periphery of the bottom 110.

A first folding line b1 and a second folding line c1 extend from each point a1 toward an outer periphery of the sheet 101. Further, an imaginary line f1 is set at a position that is in a line symmetry with the second folding line c1 relative to the first folding line b1.

A flap 112 is continuously provided, via a flap folding back line d1, at an outer end in a radial direction of the side wall 111 provided between the two second folding lines c1. Further, an insertion piece 113 is continuously provided, via an insertion piece folding back line e1, at an outer end of the flap 112.

An outer periphery of the side wall 111' provided between the two imaginary lines f1 curves so as to outwardly project in a radial direction.

Figure 4C:
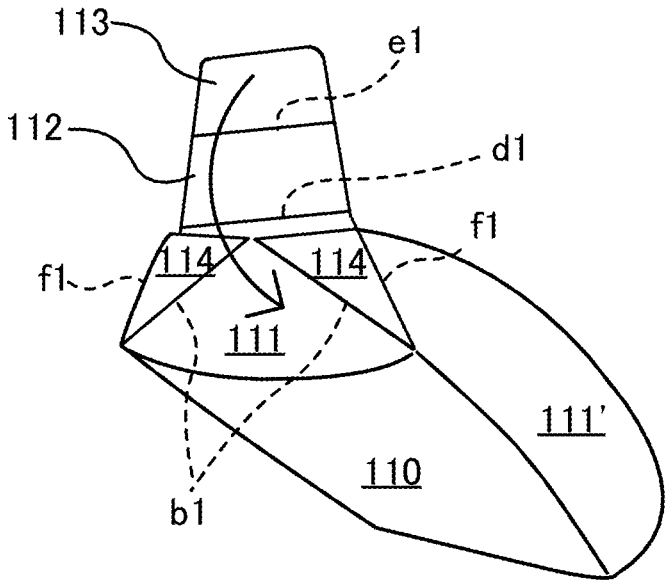
FIG. 4C is a perspective view showing the forming procedure of the folded-sheet container according to the second embodiment of the present invention.

As shown in FIG. 4C, the sheet 101 is mountain-folded along the first folding line b1 and a portion between the first folding line b1 and the second folding line c1 and a portion between the first folding line b1 and the imaginary line f1 are overlaid to form a dart portion 114. In this manner, the side walls 111, 111' can be raised from the periphery of the bottom 110.

The dart portion 114 is in a triangle shape widened on the upper side, and is valley-folded along the second folding line c1 to be overlaid on an outer surface of the side wall 111. The side wall 111' curves so as to project toward an outer surface side in a plan view.

Next, the flap 112 is outwardly folded downward from the flap folding back line d1 to sandwich the dart portions 114 between the flap 112 and the side wall 111.

Figure 4D:
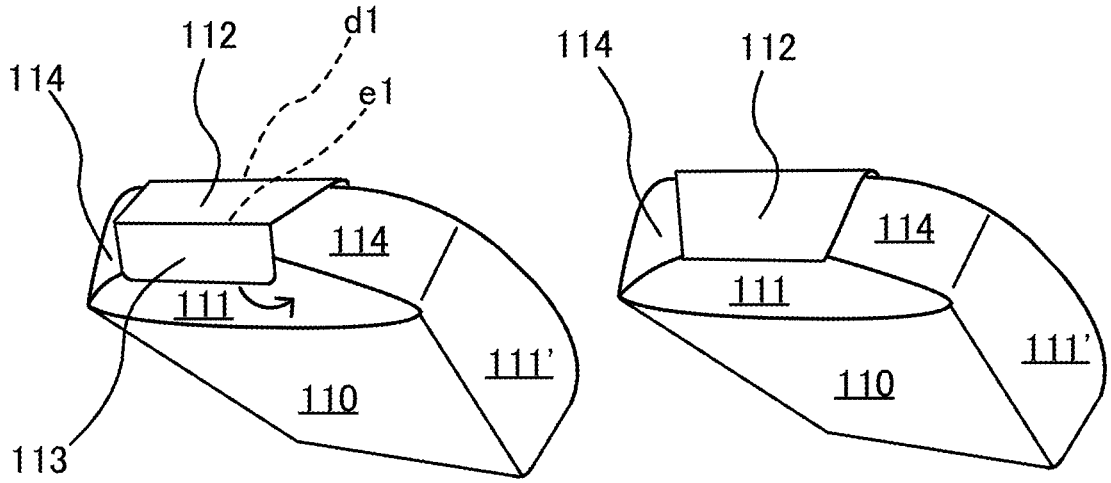
FIG. 4D is a perspective view showing the forming procedure of the folded-sheet container according to the second embodiment of the present invention.

Thereafter, as shown in FIG. 4D, the insertion piece 113 is folded back along the insertion piece folding back line e1 to be inserted into the dart portions 114 on the opposite sides from below. Then, the flap 112 and the insertion piece 113 sandwich and lock the dart portions 114. In this manner, the insertion piece 113 is inserted into the dart portions 114 so as not to easily fall off, and the plate C as shown in FIG. 3 is completed.

Third Embodiment

A third embodiment of the present invention will be described with reference to FIG. 5 and FIG. 6A to FIG. 6E. The detailed description of the portions common to the first and the second embodiments will be omitted.

Figure 5:
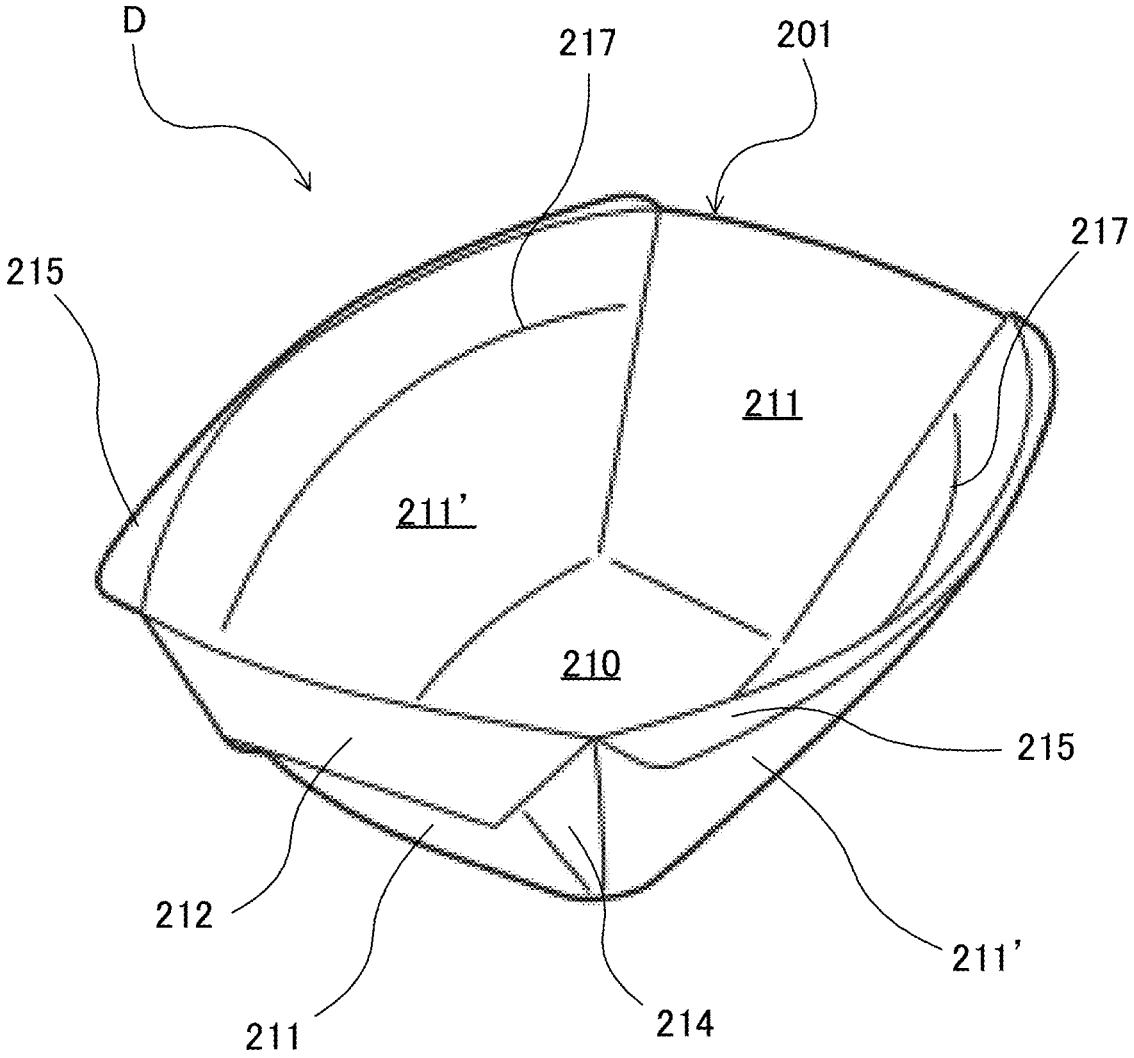
FIG. 5 is a perspective view of the folded-sheet container showing a third embodiment of the present invention.

As shown in FIG. 5, in the present embodiment, the folded-sheet container is a bowl D.

The bowl D is formed by folding a sheet 201 such that two pairs of opposing two side walls 211 as one pair and opposing two side walls 211' as one pair are raised from four sides of a quadrangular bottom 210.

As for the dimensions with which the side walls 211, 211' are raised, the height is greater than that of the side walls 111, 111' in the second embodiment, and the side walls 211 as one pair are narrower than the side walls 211' as the other pair.

The side wall 211', which is wider, is curved so as to outwardly project in a plan view, and a flange 215 protrudes along an upper end of the side wall 211'.

Figure 6A:
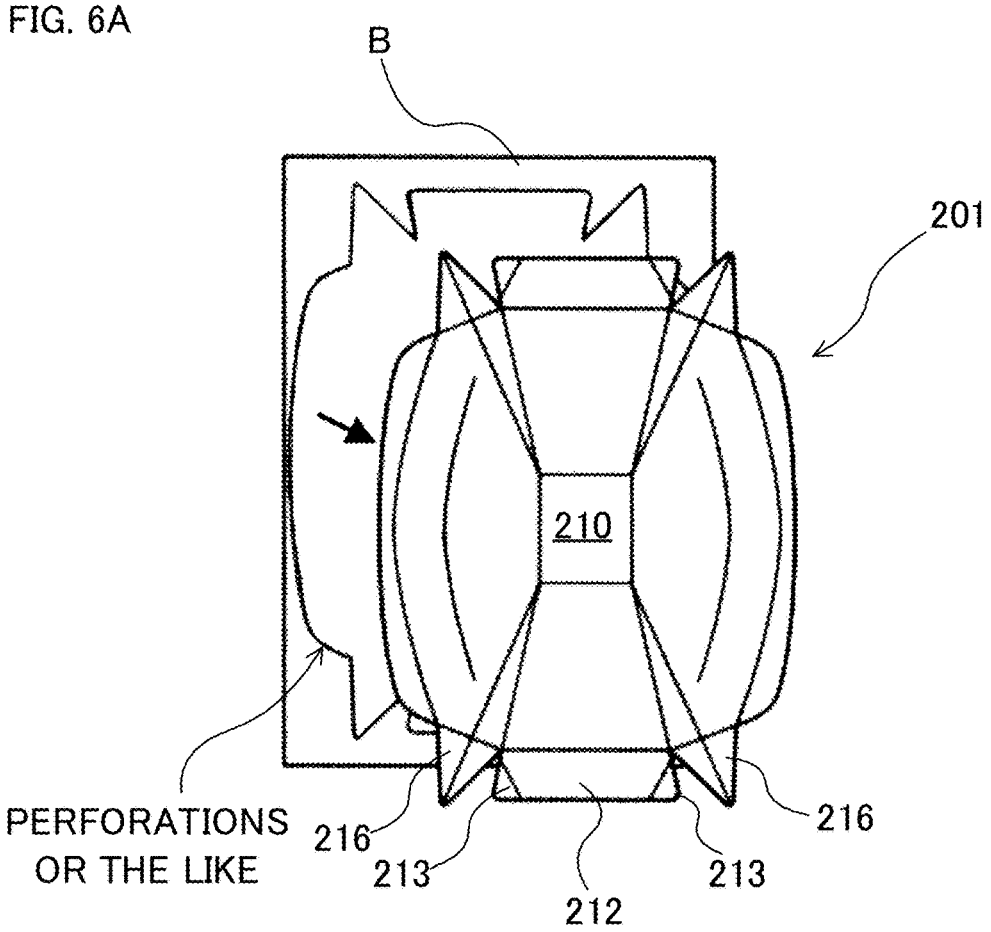
FIG. 6A is a plan view showing a forming procedure of the folded-sheet container according to the third embodiment of the present invention.

As shown in FIG. 6A, the sheet 201 is cut out from the mount B.

Figure 6B:
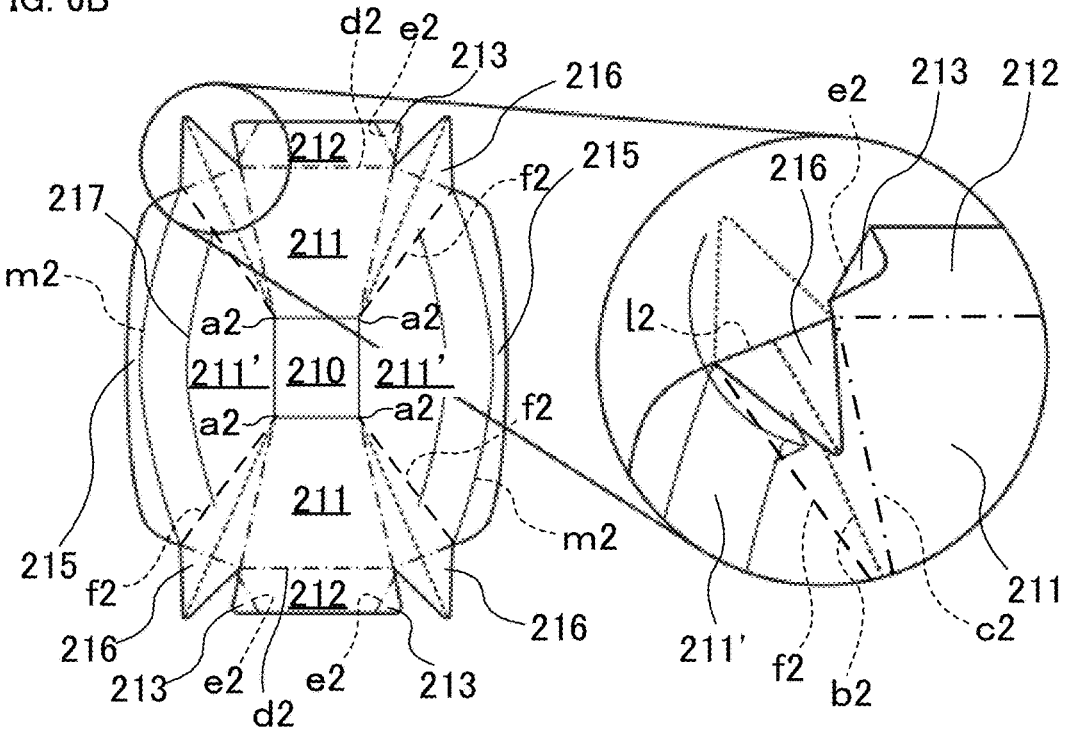
FIG. 6B is a plan view showing the forming procedure of the folded-sheet container according to the third embodiment of the present invention.

As shown in FIG. 6B, the bottom 210 is demarcated in a center portion of the sheet 201. Further, a first folding line b2 and a second folding line c2 are formed toward an outer periphery of the sheet 1 from each of points a2 set at four corners on a periphery of the bottom 210.

A trapezoidal flap 212 widened on a tip end side is continuously provided, via a flap folding back line d2, at a tip end of the side wall 211 formed between the two second folding lines c2. Insertion pieces 213 are continuously provided on opposite side portions of the flap 212 via insertion piece folding back lines e2 that are inclined from side rims of the flap 212 toward the tip end of the flap 212 so as to approach to each other.

An imaginary line f2 is set at a position that is in a line symmetry with the second folding line c2 relative to the first folding line b2. Further, the side wall 211' is formed in a portion between the two imaginary lines f2. Furthermore, a portion sandwiched between the second folding line c2 and the imaginary line f2 becomes a dart portion 214 (see FIG. 6C).

A tip end portion of the dart portion 214 forms a triangular locking portion 216 having a tip end of the first folding line b2 as the apex. The locking portion 216 outwardly projects between the insertion piece 213 and the side wall 211' via a locking portion folding back line 12.

The flange 215 is continuously provided at a tip end of the side wall 211' via a curved flange bending line m2. With the flange 215 provided, the side wall 211' can be prevented from bending, so that a further stable shape can be secured. In addition, even when a liquid or the like with a high temperature is put in the bowl D, since a portion of the flange 215 can be held, the bowl D can be stably held with no heat felt. Further, a reinforcing rib 217, which is concentric with the flange bending line m2, is formed in the side wall 211'.

Figure 6C:
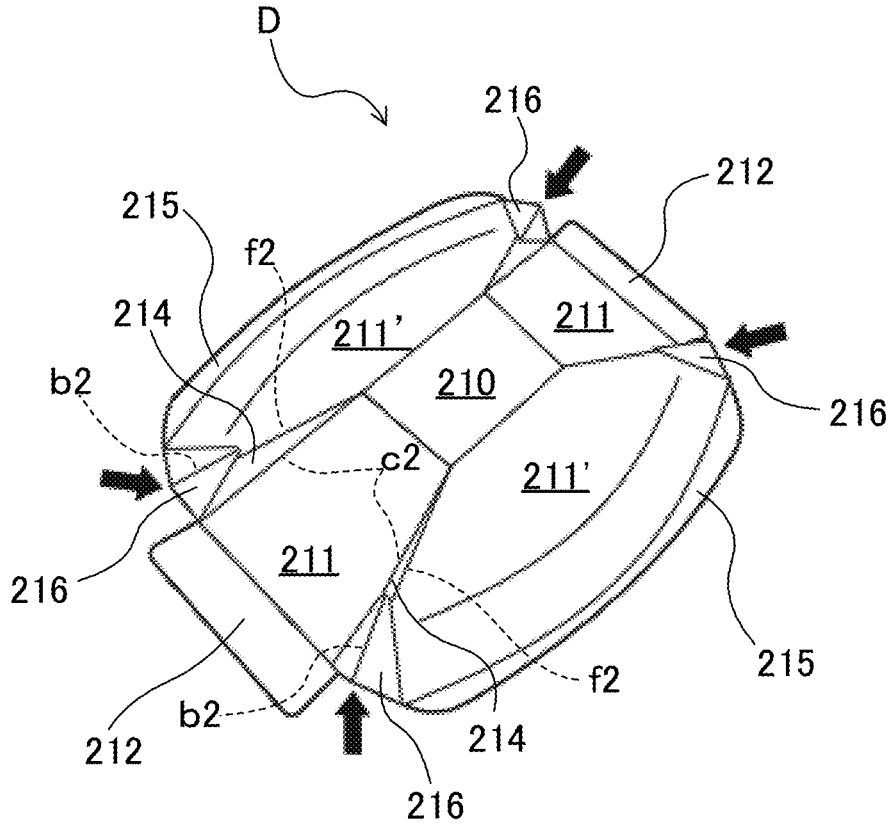
FIG. 6C is a perspective view showing the forming procedure of the folded-sheet container according to the third embodiment of the present invention.

To fold the sheet 201, first, the locking portion 216 is folded toward an outer surface side along the locking portion folding back line 12, as shown in FIG. 6B and FIG. 6C.

Figure 6D:
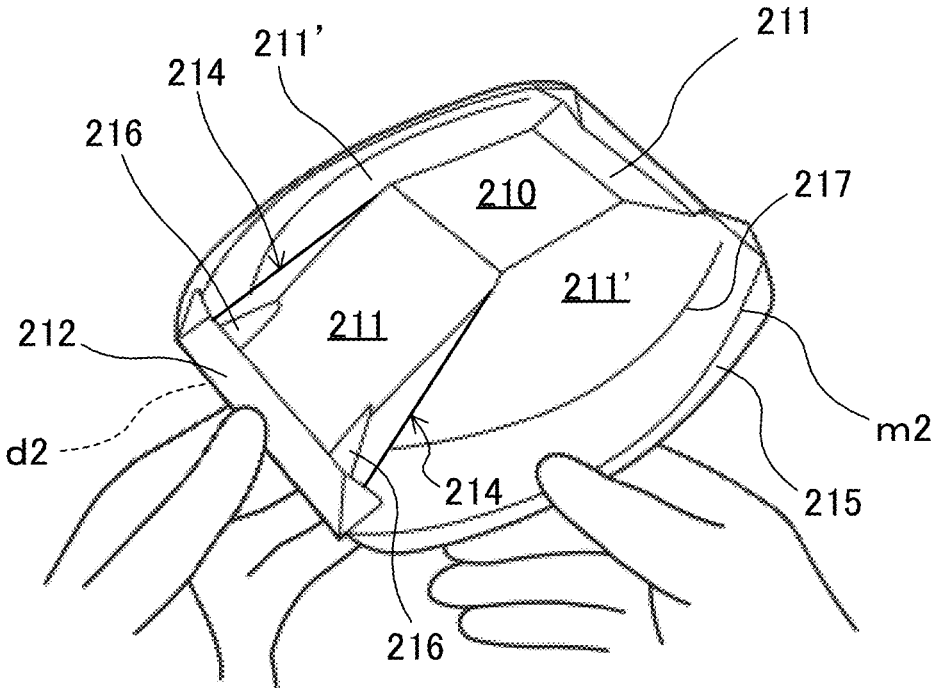
FIG. 6D is a perspective view showing the forming procedure of the folded-sheet container according to the third embodiment of the present invention.

Next, as shown in FIG. 6C and FIG. 6D, mountain-folding is performed along the first folding line b2 and opposite sides of the first folding line b2 and the locking portion 216 are overlaid to form the dart portion 214. In this manner, the side walls 211, 211' are raised from the periphery of the bottom 210. The locking portion 216 is folded downward so as to surround an outer surface of the dart portion 214.

Thereafter, the flap 212 is folded toward an outer surface side along the flap folding back line d2 to sandwich the dart portion 214 and the locking portion 216 between the side wall 211 and the flap 212.

Figure 6E:
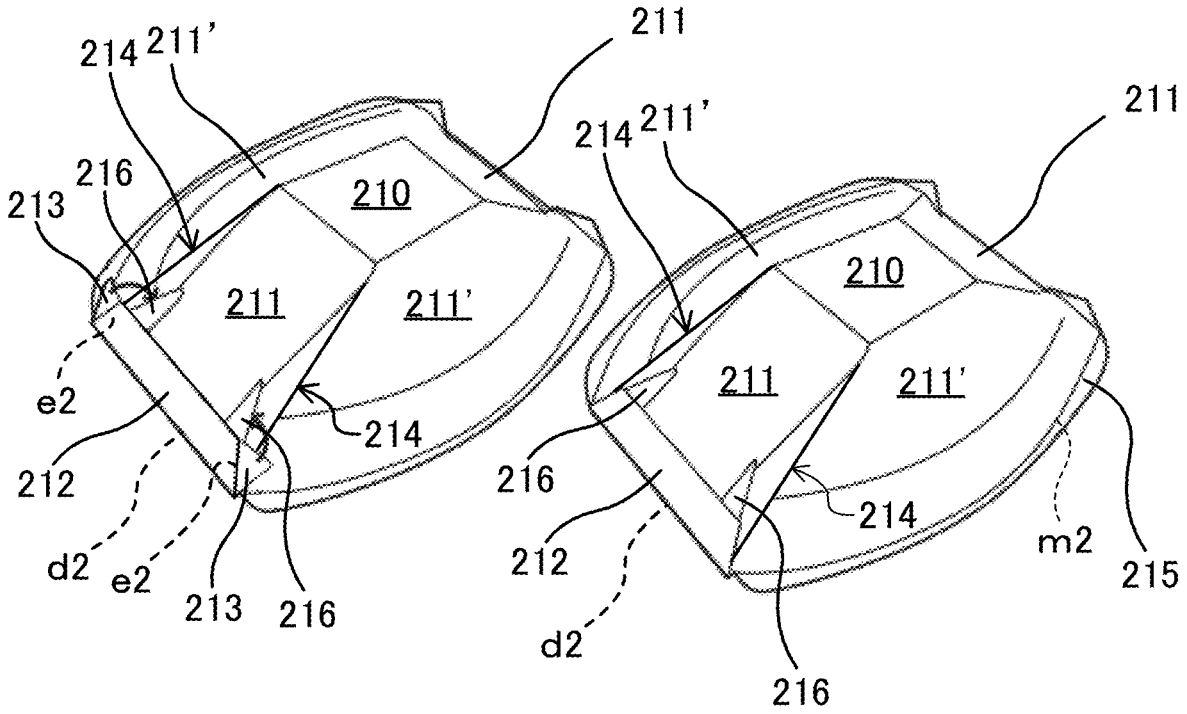
FIG. 6E is a perspective view showing the forming procedure of the folded-sheet container according to the third embodiment of the present invention.

Next, as shown in FIG. 6E, the insertion pieces 213 formed on the opposite sides of the flap 212 are folded toward an inner surface side from the insertion piece folding back lines e2 to be inserted into the locking portions 216 folded in a tubular shape. In this manner, the flap 212 and the insertion pieces 213 sandwich and lock the locking portions 216 on the opposite sides.

Further, the flange 215 is folded toward an outer surface side of the bowl D along the flange bending line m2 and the flange 201 is caused to protrude from an upper end of the side wall 211'. In this manner, the bowl D as shown in FIG. 5 is formed.

The present invention is not limited to the aforementioned embodiments. For example, the following is also encompassed.

In the present embodiments, in all of the cup A, the plate C, and the bowl D, the side walls with four faces are raised from the periphery of the bottom, but the side walls may have three faces or two curved faces or more than four faces.

It is also possible to overlay the dart portions on an inner surface of the side wall and to fold the flap provided at the upper end of the side wall toward the inner surface side. However, to flatten the inner surface of the container, it is preferable to overlay the dart portions on the outer surface of the side wall and to fold the flap toward the outer surface side of the container, as in the present embodiments.

In the first embodiment, two handles are attached to the cup A, but the handle may be omitted or only one handle may be attached.

Instead of a separate handle, a handle folded so as to have a cross section in an inverted U shape may be formed such that it is outwardly extended integrally from the upper end of the side wall.

In the third embodiment, the flange protrudes from the upper end of the curved side wall, but in a case where the side wall is narrow or the like, the flange may not be provided.

In the description, one reinforcing rib is formed in the side wall, but a plurality of those may be formed or the reinforcing rib may be omitted. Further, the reinforcing rib can be used not only for reinforcing function, but also as a scale to indicate the volume of a liquid or the like to be put in.

The invention claimed is:

1. A folded-sheet container formed by folding a sheet, the folded-sheet container comprising:

a bottom provided in a substantially center portion of the sheet;

a side wall provided adjacent to the bottom;

a further side wall provided adjacent to the bottom at a side opposite to the side wall;

a first folding line and a second folding line that are provided from a point in a periphery portion of the bottom toward an outer periphery of the sheet;

a dart portion formed by folding back the sheet along the first folding line;

a flap that is provided in an end portion opposing the bottom of the side wall and that can be folded back; and an insertion piece provided in the flap, wherein the dart portion is folded back along the second folding line to be overlaid on the side wall, the flap is folded back to sandwich the dart portion between the side wall and the flap, the insertion piece provided in the flap is folded back to be inserted into the dart portion, opposing two side walls are defined by the side wall and the further side wall, and the opposing two side walls as one pair are both curved so as to outwardly project in a radial direction in a plan view.

2. The folded-sheet container according to claim 1, wherein the dart portion is overlaid on an outer surface of the side wall and the flap is folded back toward an outer surface side.

3. The folded-sheet container according to claim 1, wherein the dart portion and a further dart portion positioned on opposite sides of the side wall are overlaid on the side wall, the insertion piece is provided, at a tip end of the flap provided in an end portion of the side wall, between the dart portion and the further dart portion positioned on the opposite sides, and the insertion piece is folded back to be inserted into the dart portion and the further dart portion on the opposite sides.

4. The folded-sheet container according to claim 1, wherein the opposing two side walls are bent and curved with a bending line.

5. A folded-sheet container formed by folding a sheet, the folded-sheet container comprising:

a bottom provided in a substantially center portion of the sheet;

a side wall provided adjacent to the bottom;

a first folding line and a second folding line that are provided from a point in a periphery portion of the bottom toward an outer periphery of the sheet;

a dart portion formed by folding back the sheet along the first folding line;

a flap that is provided in an end portion opposing the bottom of the side wall and that can be folded back; and an insertion piece provided in the flap, wherein the dart portion is folded back along the second folding line to be overlaid on the side wall, the flap is folded back to sandwich the dart portion between the side wall and the flap, the insertion piece provided in the flap is folded back to be inserted into the dart portion, and locking portions are formed by overlaying the dart portions positioned on opposite sides of the side wall on the side wall and folding upper portions of the dart portions downward, the insertion pieces are provided in opposite side portions of the flap provided at an upper end of the side wall, and the insertion pieces are folded back to be inserted into the locking portions on the opposite sides.

* * * * *